United States Patent [19]

Anthony

[11] 4,153,250

[45] May 8, 1979

[54] GRAVITY-TYPE RACING GAME

[76] Inventor: Zacharias Anthony, 181 Atlantic Ave., Long Branch, N.J. 07740

[21] Appl. No.: 885,760

[22] Filed: Mar. 13, 1978

[51] Int. Cl.[2] ..... A63F 9/14

[52] U.S. Cl. ..... 273/86 C; 273/120 A; 273/129 HA

[58] Field of Search ..... 273/86 R, 86 B, 86 C, 273/119 R, 119 A, 120 R, 120 A, 121 R, 121 A, 129 HA

[56] References Cited

U.S. PATENT DOCUMENTS

| | | | |
|---|---|---|---|
| 597,764 | 1/1898 | De Ribas | 273/86 C |
| 1,493,649 | 5/1924 | Schulz | 273/86 C |
| 1,660,715 | 2/1928 | Lingenfelder | 273/86 B |
| 2,008,588 | 7/1935 | Moodie | 273/86 C UX |
| 2,899,206 | 8/1959 | Carter | 273/120 R |
| 3,057,623 | 10/1962 | Barnes | 273/246 |
| 3,451,678 | 6/1969 | Gehrts | 273/86 C |
| 3,559,637 | 2/1971 | Fyanes | 273/86 C X |
| 3,630,524 | 12/1971 | Cooper | 273/86 R |

*Primary Examiner*—Anton O. Oechsle
*Attorney, Agent, or Firm*—Lerner, David, Littenberg & Samuel

[57] ABSTRACT

A gravity-type racing game is provided which includes start and finish positions connected by an inclined trackway. Playing objects, such as balls, are assignable to each of the players, and a plurality of such balls are released from the start position to traverse the inclined trackway toward the finish position. Rotatable and flipper-type deflectors are disposed on the inclined trackway for deflecting the balls as they approach the finish position. A plurality of playing stations are provided for the players, and each player's station includes a control button. The control buttons are all connected in parallel to the same deflectors and are operable by each player for actuating the same deflectors. In this manner, each player may actuate the same deflectors to deflect the ball of another player away from the finish position.

11 Claims, 5 Drawing Figures

GRAVITY-TYPE RACING GAME

FIELD OF THE INVENTION

The present invention relates generally to gravity-type racing games, and specifically to a novel control arrangement wherein a plurality of player-operated control buttons are all connected in parallel to the same deflectors, so that any player may actuate the same deflectors to deflect the playing object of another player away from the finish position of the game.

BACKGROUND OF THE INVENTION

Gravity-type racing games have been well known for many years. Typically, such racing games include start and finish positions connected by an inclined, and sometimes circuitous, trackway. In operation, the first object to traverse the inclined trackway and reach the finish position wins the game. In addition, many variations have been included in such racing games. For, example, as shown in U.S. Pat. No. 2,008,588, the inclined trackway may include rocking portions through which the playing object is caused to travel. Also, the finish positions or stations of such games have been provided with various devices for easily indicating the winning playing object. For example, as shown in U.S. Pat. No. 1,493,649, the first playing object to reach the finish position actuates a trapdoor so that subsequent playing objects enter a separate chamber.

In view of the foregoing, it will be appreciated that there is a desire to add further variations to such gravity-type racing games which will increase the interest and excitement provided to the players of such games.

Accordingly, it is an object of the present invention to provide an improved gravity-type racing game which fulfills this desire. Specifically, it is within the contemplation of the present invention to provide an improved racing game wherein each player can actuate the same deflectors to deflect the playing objects of their opponents away from the finish position to enhance the chances of their own playing object being the first to reach the finish position.

It is a further object of the present invention to provide an improved control arrangement for such gravity-type racing games wherein the player-operated control devices are all connected in parallel to the same deflectors, so that any player may actuate the same deflectors to deflect the playing objects of their opponents away from the finish position.

SUMMARY OF THE INVENTION

Briefly, in accordance with the principles of the present invention, an improved gravity-type racing game is provided which includes start and finish positions connected by an inclined trackway over which a plurality of playing objects race toward the finish position. In order to increase the excitement of such a game, and in order to provide the individual players with the ability to effect or control the outcome of the game, deflectors are disposed on the inclined trackway for deflecting the playing objects of their opponents away from the finish position. A plurality of player-operated control buttons are all connected in parallel to the same deflectors, so that any individual player may actuate the deflectors to deflect the playing object of his opponent as his opponent's playing object approaches the finish position.

The excitement and enjoyment of such a game is greatly increased, since each player has the ability to actuate the deflectors into blocking or non-blocking positions. Therefore, if the playing object of one player is approaching the finish position and the deflectors are in a blocking position, the player can actuate the deflectors into a non-blocking position. However, any of his opponents have the ability to again deflect the deflectors back into a blocking position.

As will be apparent, the racing game of the present invention greatly increases the interest of the players, since they have the ability to employ their skill to change or effect the outcome of this game of chance. Moreover, the racing game of the present invention provides continued interest to the players, as it allows each player to improve his skill and reaction time to actuate the deflectors and thereby effect the outcome of the game.

BRIEF DESCRIPTION OF THE DRAWINGS

Further objects, features, and advantages of the present invention will become apparent upon the consideration of the following detailed description of a presently-preferred embodiment when taken in conjunction with the accompanying drawings, wherein.

DETAILED DISCUSSION OF PREFERRED EMBODIMENT OF THE INVENTION

Figure 1:
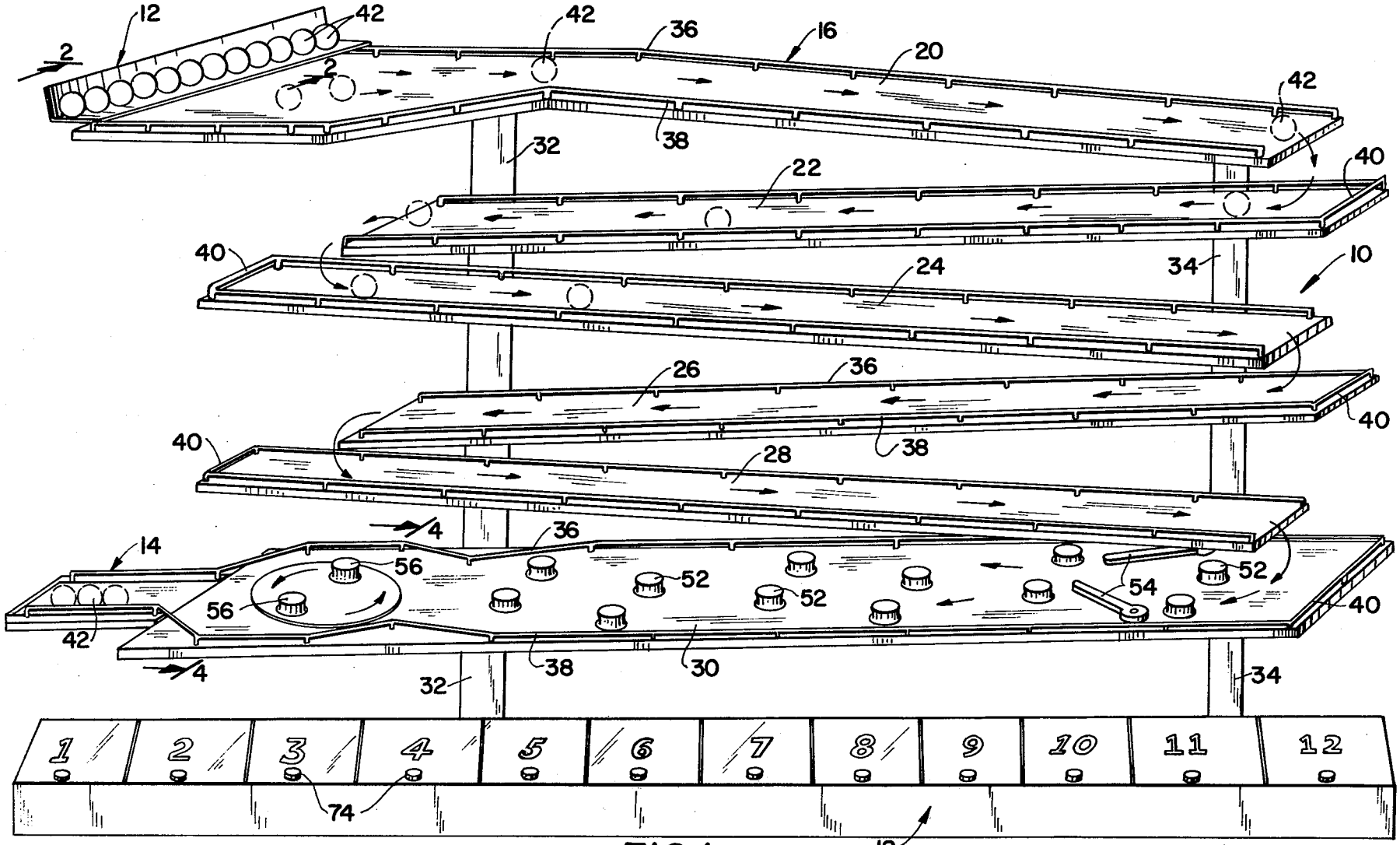
FIG. 1 is a perspective view of a gravity-type racing game embodying the present invention.

Referring now to FIG. 1, there is shown a gravity-type racing game embodying the present invention, generally designated by the reference numeral 10, which includes a starting position or station 12, a finish position or station 14, and an inclined trackway 16 connecting starting station 12 and finish station 14. In addition, a plurality of player stations 18 are provided for the players.

As will be seen in FIG. 1, inclined trackway 16 includes a plurality of individual inclined trackways or runways 20, 22, 24, 26, 28, and 30. Each of these runways is disposed one above the other and is mounted on any suitable means, such as supporting elements 32, 34. Each of the runways or trackways 20, 22, 24, 26, 28, and 30 includes guide rails 36, 38 disposed on either side thereof. In addition, runways 22, 24, 26, 28, and 30 each include, respectively, guide rails 40 disposed at one end thereof to define the trackway. In this manner, runways 22, 24, 26, 28, and 30 are each enclosed on three sides by guide rails in order to guide the playing objects so that they will drop from one runway to the next lower runway as they traverse inclined trackway 16.

In the present embodiment, the playing objects of the game are illustrated as spheres or balls 42. However, it will be understood that any suitable playing object may be employed in the present game as long as it is capable of traversing an inclined trackway and to be propelled along the trackway by gravity.

Figure 2:
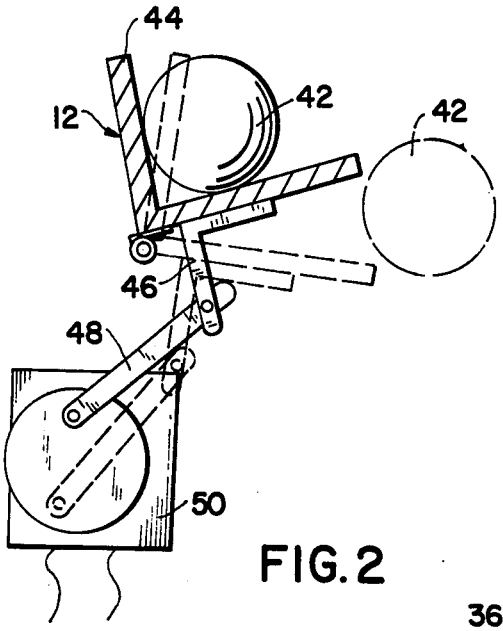
FIG. 2 illustrates in detail the device for releasing the playing objects from the starting position of the inclined trackway.

Turning now to FIG. 2, the starting position 12 is illustrated in detail. In order to prepare the game for play, the plurality of playing objects 42 is disposed on a starting gate 44 which may be pivoted from a holding position to a release position to release balls 42 to traverse the inclined trackway 16 and be guided thereby to the finish position 14. Any suitable device may be provided for moving gate 44 into the release position. As shown in FIG. 2, gate 44 is connected by linkage 46, 48 to a suitable motor 50. Linkage element 48 is eccentrically connected to the drive of motor 50 which thereby operates to move gate 44 between its holding and release positions.

By actuation of gate 44 and motor 50, all of the balls 42 are simultaneously released from the starting station 12. As shown in FIG. 1, the balls 42 will traverse the first inclined runway 20 of inclined trackway 16 until they reach the end of runway 20. At that point, balls 42 will drop onto the next lowermost runway 22 and be guided by guide rails 36, 38, and 40 along runway 22, until they reach the end thereof, at which time they will drop onto runway 24. In this manner, balls 42 will traverse each runway and be propelled by gravity in an opposite direction on each runway until the balls 42 reach the lowermost runway 30 of inclined trackway 16.

In order to enhance the excitement and enjoyment of the game, and in order to provide the individual players with the ability to employ their skill to effect the outcome of this game of chance, the lowermost inclined runway 30 is provided with a plurality of movable and stationary deflectors for engaging and deflecting balls 42 as they traverse runway 30. As shown most clearly in FIG. 1, the lowermost inclined runway 30 includes a plurality of stationary deflectors 52, which may be of any suitable type to engage and deflect balls 42, flipper-type deflectors 54, and rotatable-type deflectors 56. These deflectors 52, 54, and 56 are positioned along runway 30 in any desired orientation, and as will be explained herein, operate to deflect balls 42 away from the finish position 14, and thereby effect the outcome of this game of chance.

Figure 3:
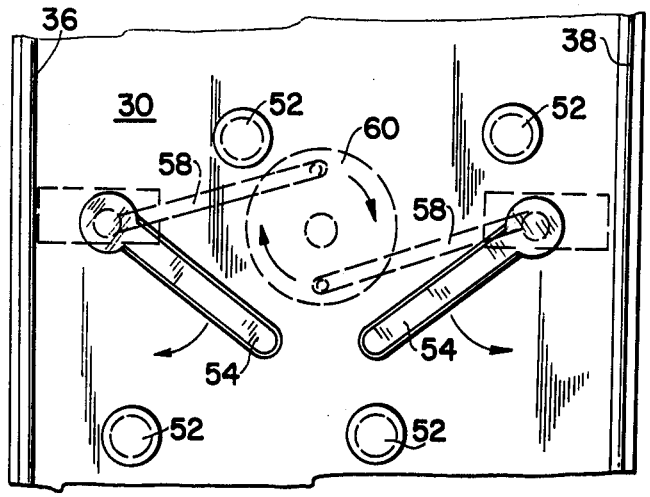
FIG. 3 is a detailed illustration of the flipper-type deflectors and the means for actuating same.

Turning now to FIG. 3, the details for controlling the movement of flipper-type deflectors 54 are illustrated. Each flipper-type deflector 54 is connected by respective linkage elements 58 to the output drive 60 of a suitable motor 62. Therefore, when motor 62 is actuated, output drive 60 will rotate and thereby move linkage elements 58 which are pivotally connected to flippers 54. In this manner, as output drive 60 rotates, flippers 54 will be actuated towards each other, as is known in the art, to engage and deflect playing objects 42 as they traverse the lowermost inclined runway 30.

Figure 4:
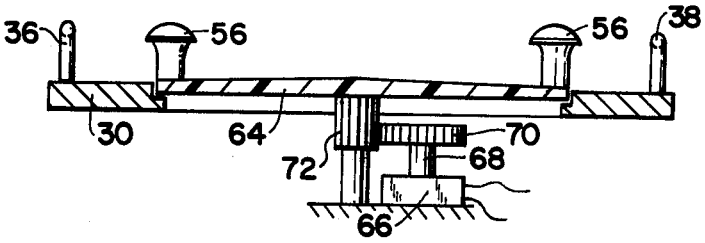
FIG. 4 is a sectional view of the inclined trackway illustrating in detail the rotating deflectors.

Turning now to FIG. 4, the details of rotating deflectors 56 are illustrated. Deflectors 56 are mounted on a turntable 64, the top surface of which is generally planar with the top surface of runway 30. As will be seen, rotating turntable 64 is mounted within an opening formed within runway 30, so that it can rotate relative thereto. To rotate turntable 64 and deflectors 56, a suitable motor 66 is provided and includes an output shaft 68 for driving a gear 70. As will be seen, gear 70 meshes with and drives a gear 72 connected to turntable 64. In this manner, actuation of motor 66 operates to rotate turntable 64 and deflectors 56 mounted thereon so that deflectors 56 can be actuated to deflect balls 42 as they traverse runway 30.

Figure 5:
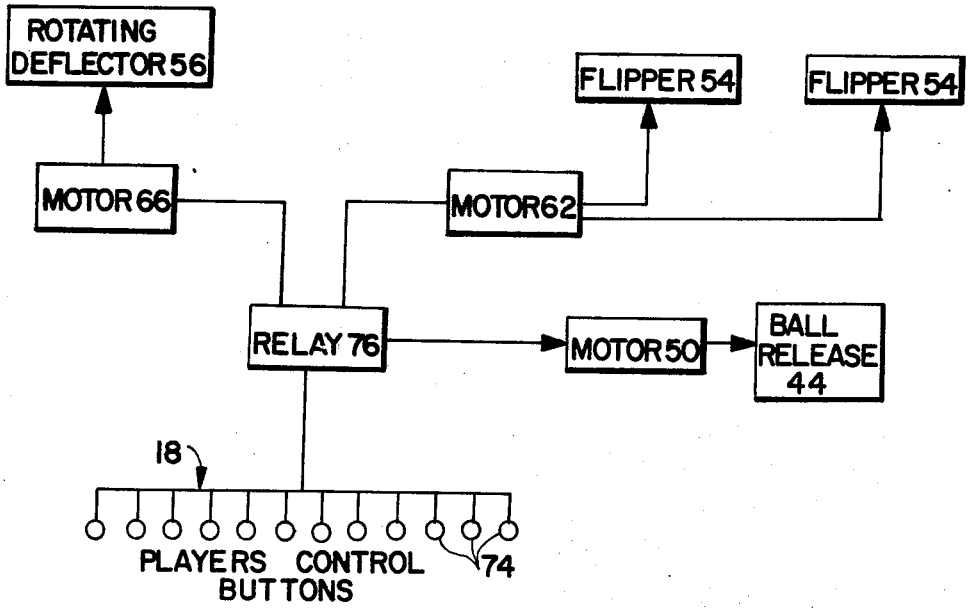
FIG. 5 is a schematic diagram illustrating the control arrangement for controlling the rotating deflectors and the flipper-type deflectors of the present invention.

Turning now to FIG. 5, there is a schematic representation of the control arrangement for controlling the racing game of the present invention. As stated above, a plurality of player stations is shown at 18. In this particular embodiment, 12 such player positions are illustrated, with each player position having its own player-control button 74. The player-control buttons 74 are all connected in parallel, so that they can be simultaneously operated to actuate the flippers 54 and rotating deflectors 56. More particularly, each of the player-control buttons 74 is connected in parallel via a suitable relay 76 to motors 50, 62, and 66 for controlling, respectively, ball release 44, flippers 54, and rotating deflectors 56.

A brief description of the operation of the racing game of the present invention will now be provided. If there are 12 players, each of the players is located at one of the player stations 1 through 12, and each player has access to a control button 74 at each of the player stations 18. In addition, if it is desired that the game include betting, each player places the desired amount on the number at his player station. Then, each of the playing balls 42 is placed in the holding position on gate 44, with each of the balls 42 including numbers 1 through 12 thereon corresponding to the 12 player positions. Once each of the players is in position, the person in control of the game actuates motor 50 to move gate 44 from its holding position to its release position, so that balls 42 are released from starting position 12 and traverse the inclined trackway 16. As explained above, balls 42 will traverse runways 20, 22, 24, 26, 28 and finally drop onto the lowermost runway 30. As the first balls 42 drop onto runway 30, the players who wish to deflect these balls belonging to their opponents will actuate their player-control buttons 74 which will operate through motor 62 to actuate flippers 54 to deflect the playing balls 42. Eventually, one or more of the playing balls 42 will pass flippers 54 and begin to engage the maze of stationary bumpers 52 and be deflected thereby. Eventually, one or more balls 42 will make their way through stationary bumpers 52 and approach deflectors 56. At that time, the players who wish to deflect the playing balls of their opponents will actuate their control buttons 74 which will operate via motor 66 to rotate turntable 64 and deflectors 56 from a non-blocking position to a blocking position. Of course, any player whose playing ball is approaching deflectors 56 will also attempt to rotate deflectors 56 out of a blocking position, so that this player's ball will enter finish station 14 in the first, second, or third positions, as shown in FIG. 1. As a result, the first three balls 42 to enter finish station 14 indicate the first, second, and third place winners. Of course, other methods of betting and of playing the game employing the disclosed apparatus may be used, and the foregoing description of the method of play is only representative.

In addition, although FIG. 5 has been illustrated such that the control buttons 74 simultaneously actuate rotating deflectors 56 and flippers 54, it will of course be understood that, if desired, separate control buttons can be provided for the flippers and rotating deflectors, so that each player will have at least two control buttons, one for actuating the flippers and one for actuating the rotating deflectors. In addition, it will be understood that as long as a player-control button is actuated, turntable 64 will continue to rotate. Preferably, it is desired that each time a control button 74 is depressed, it will cause turntable 64 to rotate a predetermined increment. Therefore, if control buttons 74 are operated repetitively, turntable 64 will move each increment, but will appear to be rotating continuously.

In view of the foregoing, it will be appreciated that a new and exciting racing game has been provided which allows the individual players to employ their skill to effect or change the outcome of this game of chance. In addition, the more each player plays the game, he will improve his reaction time and thereby increase his skill in the play of the game.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A gravity-type racing game, comprising:

a start position and a finish position, an inclined trackway connecting said start and finish positions, a plurality of playing objects assignable to a plurality of players;

means for simultaneously releasing said playing objects from said start position to traverse said inclined trackway toward said finish position, means disposed on said inclined trackway for movement on said inclined trackway for deflecting said playing objects away from said finish position, and a plurality of control means each operable by a player for actuating said same movable deflecting means so that any player may actuate said same deflecting means to deflect the playing object of another player away from said finish position.

2. A racing game in accordance with claim 1 further including a plurality of stations for said players, each of said player stations including at least one of said plurality of control means

3. A racing game in accordance with claim 1 wherein said deflecting means includes deflectors mounted for rotation between blocking and non-blocking positions.

4. A racing game in accordance with claim 1 wherein said deflecting means includes a plurality of rotatable deflectors and a plurality of flipper-type deflectors.

5. A racing game in accordance with claim 1 wherein said deflecting means includes deflectors mounted for rotation on a turntable between blocking and non-blocking positions.

6. A racing game in accordance with claim 1 wherein said control means includes means for continuously energizing said deflecting means to rotate continuously.

7. A racing game in accordance with claim 1 wherein said inclined trackway includes a plurality of elongated inclined runways disposed one above the other so that said playing objects drop from one inclined runway to the next lower inclined runway as they traverse said inclined trackway.

8. A racing game in accordance with claim 7 wherein said lowermost runway includes said finish position and said deflecting means.

9. A racing game in accordance with claim 1 further including a betting board having marked areas thereon for placing bets on the playing objects used in said racing game.

10. A racing game in accordance with claim 1 wherein said playing objects are spheres which roll along said inclined trackway toward said finish position.

11. A racing game in accordance with claim 1 wherein said finish position includes a narrow chute which only allows playing objects to enter said chute one behind the other so that the winner of the racing game may be easily designated.

* * * * *